US007318255B2

(12) United States Patent
Bastian et al.

(10) Patent No.: US 7,318,255 B2
(45) **Date of Patent: *Jan. 15, 2008**

(54) CROSS LAPPER

(75) Inventors: Peter Bastian, Fürfeld (DE); Joachim Leger, Eberbach (DE)

(73) Assignee: Oskar Dilo Maschinenfabrik KG (DE)

( * ) Notice: Subject to any disclaimer, the term of this patent is extended or adjusted under 35 U.S.C. 154(b) by 348 days.

This patent is subject to a terminal disclaimer.

(21) Appl. No.: 11/075,123

(22) Filed: Mar. 8, 2005

(65) Prior Publication Data

US 2005/0217077 A1 Oct. 6, 2005

(30) Foreign Application Priority Data

Apr. 2, 2004 (EP) ..... 04008051

(51) Int. Cl.
*D01G 25/00* (2006.01)

(52) U.S. Cl. ..... 19/296; 19/161.1

(58) Field of Classification Search ..... 19/161.1–163, 19/296; 270/32, 39.05, 40, 41
See application file for complete search history.

(56) References Cited

U.S. PATENT DOCUMENTS 2,962,772 A * 12/1960 Draving et al. ..... 19/163
3,222,730 A 12/1965 Kalwaites
4,984,772 A * 1/1991 Freund ..... 270/30.01
5,007,623 A 4/1991 Unkuri et al.
5,590,442 A 1/1997 Hirschek et al.
RE35,982 E * 12/1998 Freund ..... 191/63
6,662,407 B2 * 12/2003 Bernhardt et al. ..... 19/161.1
2005/0193525 A1 * 9/2005 Leger ..... 19/63
2005/0193526 A1 * 9/2005 Leger ..... 19/163
2005/0217077 A1 * 10/2005 Bastian et al. ..... 19/161.1

FOREIGN PATENT DOCUMENTS

EP 0528348 2/1993

* cited by examiner

*Primary Examiner*—Shaun R. Hurley
(74) *Attorney, Agent, or Firm*—Jansson Shupe & Munger Ltd.

(57) ABSTRACT

In a camel back cross lapper, a fiber web to be layered to form a fleece is guided from an infeed zone until its discharge in a layering zone in sandwiched manner between two transport belts extending over the arms of the cross lapper. The transport belts are extended over a layering zone on an output conveyor to cover the web freshly deposited onto the output conveyor to avoid the web from being affected by harmful aerodynamic effects created by the movement of the layering arm of the cross lapper. In an embodiment, a web buffer is combined with the cross lapper such manner that the transport belts extend through web buffer.

16 Claims, 2 Drawing Sheets

CROSS LAPPER

RELATED APPLICATION

This application claims the benefit of EP 04 008 051.7, filed on Apr. 2, 2004, the contents of which are incorporated herein.

FIELD OF THE INVENTION

This invention is related to the field of producing non-woven fabric or fleece made from fiber material. More particularly, the invention relates to machinery known as a cross lapper.

BACKGROUND OF THE INVENTION

When laying a fiber web (hereinafter referred to as web) onto an output conveyor, the laying arm of the cross lapper performs a pivoting movement, wherein its lower, free end moves in close distance over the output conveyor transversely to the transport direction of the latter. If the upper end of the laying arm is pivotally attached on a pivotally mounted supply arm, the supply arm also performs a pivoting movement. A cross lapper of this type, also referred to as a camel back cross lapper, is generally known and, for instance, is described in the book "Vliesstoffe", Verlag Wiley-VCH, Weinheim, 2000 (page 160).

In known camel back cross lappers, the lower end of the laying arm is coupled to a carriage which is movably guided on rails transversely to the transport direction of the output conveyor. The carriage is connected to a drive means so that by the aid of this drive means, the pivoting movement of the laying arm, and possibly of the supply arm, is carried out.

The speed at which the web is discharged by the laying arm of the cross lapper may be more than 200 m/mm, but speeds in the range of 300 m/mm are desirable. The free end of the laying arm must therefore move correspondingly fast over the output conveyor to prevent disturbing the material and the creation of folds in the layered web. These high speeds lead to problems caused by aerodynamic effects. A web section layered by the laying arm may lift off its base and start fluttering under the influence of aerodynamic pull. One approach to alleviate this effect has been to provide a garnished pressure roller which felts the fibers of the freshly layered fiber web with the fibers of the web layers already layered arranged underneath. Since a laying arm usually discharges fiber web in both of its movement directions, two such pressure rollers may be mounted at the laying arm, increasing the weight of the laying arm accordingly. Further, the effect caused by such pressure rollers is relatively moderate.

OBJECTS OF THE INVENTION

It is an object of the invention to provide improved fleece laying apparatus which overcomes some of the problems and shortcomings of the prior art, including those referred to above.

Another object of the invention to provide a cross lapper capable of working at a relatively high laying speed.

Another object of the invention is to provide a cross lapper which holds the fiber web along all essentially all of its path through the cross lapper.

Another object of the invention is to provide a cross lapper which improves the quality of the fleece material produced therein.

Still another object of the invention is to provide a cross lapper which eliminates aerodynamic effects on the product manufactured.

How these and other objects are accomplished will become apparent from the following descriptions and the drawings.

SUMMARY OF THE INVENTION

The apparatus of this invention is a cross lapper for manufacturing a fiber fleece from a fiber web. The apparatus comprises: (1) a supply arm having lower and upper ends and pivotably mounted at its lower end around a stationary lower pivot axis; (2) a downwardly extending laying arm having upper and lower ends and pivotably supported at its upper end on the supply-arm upper end around an upper pivot axis parallel to the lower pivot axis, the laying-arm lower end being movable in a substantially straight path; (3) an endless output conveyor extending substantially parallel to the pivot axes and having a laying zone below the path of the laying-arm lower end; (4) two reversing rollers supported on a common carriage that is disposed below the output conveyor and is movable transversely thereto; (5) two endless transport belts juxtaposed for clamping and transporting the fiber to be layered and guided along the supply and arms for receiving a fiber web at an infeed zone and for laying the fiber web in the laying zone on the output conveyor under pivoting movement of the supply and laying arms, the juxtaposed belts forming a discharge nip at the laying-arm lower end, the belts extending beyond the nip in opposite directions transversely across the laying zone in proximity to the output conveyor, the belts being separately guided to the reversing rollers, back to the laying-arm lower end, and from there along the laying and supply arms to the infeed zone; and (6) drive apparatus for moving the belts, pivoting the supply and laying arms, and moving the output conveyor.

Preferred embodiments of the inventive cross lapper further include a pair of discharge nip rollers supported on the laying-arm lower end, and the transport belts each pass over one of the nip rollers.

In another embodiment of the inventive cross lapper, the laying-arm lower end and the carriage are connected to one another and to the drive apparatus by one of a traction rope, a toothed belt or a chain for pivoting movement of the laying and supply arms.

In a preferred embodiment, the inventive cross lapper also includes a pair of discharge nip rollers supported on the laying-arm lower end, and the transport belts each pass over one of the nip rollers.

In another preferred embodiment, the cross lapper further includes a pivot frame pivotably coupled to the laying lower end around an axis between and parallel to the nip rollers. The pivot frame is adapted to pivot such that the nip roller which is forward in the movement direction of the laying arm lower end is lifted and the other nip roller is lowered.

In a highly-preferred embodiment, the inventive cross lapper also includes web buffering apparatus disposed upstream of the supply-arm lower end, and the buffering apparatus guides the transport belts. In this embodiment, the transport belts each include feed sections and return sections. Along the feed sections, the belts, in juxtaposed fashion, transport the fiber web from a take-up site to the discharge nip, the juxtaposed belts running through a substantially U-shaped feed path portion substantially half-wrapped over a first deflecting roller. Along the return sections, the belts move from the supply arm to the take-up site guided through U-shaped return path portions oriented in directions opposite to the orientation of the U-shaped feed path portion, each belt half-wrapping one of second and third deflecting rollers, respectively. The web buffering apparatus includes a common mounting frame rotatably supporting the three deflecting rollers, thereby providing compensated length variation of the transport belts extending to and returning from the discharge nip as the laying lower end traverses the laying zone on the output conveyor.

In another preferred embodiment of the inventive cross lapper, the laying lower end and the carriage are connected to one another and to the drive apparatus by one of a traction rope, a toothed belt or a chain for pivoting movement of the laying and supply arms.

In other embodiments, the common mounting frame is movably held in a machine stand, and in some embodiments, the common mounting frame is movably held by a pendulum.

In some preferred embodiments of the inventive cross lapper, the common mounting frame is pivotably supported around the axis of the first deflecting roller.

In another preferred embodiment, the cross lapper also includes a tensioning roller about which the belt from one of the U-shaped return path portions is substantially half-wrapped, and the tensioning roller is biased away from the U-shape of such return path portion.

In other embodiments, the cross lapper of this invention further includes first and second independent drive rollers and a common drive roller, and the transport belts are each guided over one of the independent drive rollers and their feed sections are commonly guided over the common drive roller. In these embodiments, the common drive roller is driven at a circumferential speed that is variable with respect to the circumferential speeds of the first and second independent drive rollers, thus varying the discharge speed of the cross lapper with respect to its take-up speed.

In another embodiments, the cross lapper further includes first and second independent drive rollers, the transport belts each being guided over one of the independent drive rollers, and the first deflecting roller is also a driven roller driven at a circumferential speed that is variable with respect to the circumferential speeds of the first and second independent drive rollers; thus the discharge speed of the cross lapper is varied with respect to its take-up speed.

In another preferred embodiment, the inventive cross lapper further includes two return drive rollers, and each of the return sections between the supply arm and the U-shaped return path portions wrap at least 90° around a respective one of the return drive rollers.

In highly preferred embodiments, the supply and laying arms each have guide rollers alternatingly contacting opposite sides of the juxtaposed feed sections of the transport belts.

In other highly preferred embodiments, the inventive cross lapper further includes two return drive rollers, each of the return sections between the supply arm and the U-shaped return path portions wrap at least 90° around a respective one of the return drive rollers.

The drawings show the essential features only of the invention, and this in schematic view only, since a schematic view is sufficient for understanding the invention.

DETAILED DESCRIPTION OF PREFERRED EMBODIMENTS

Figure 1:
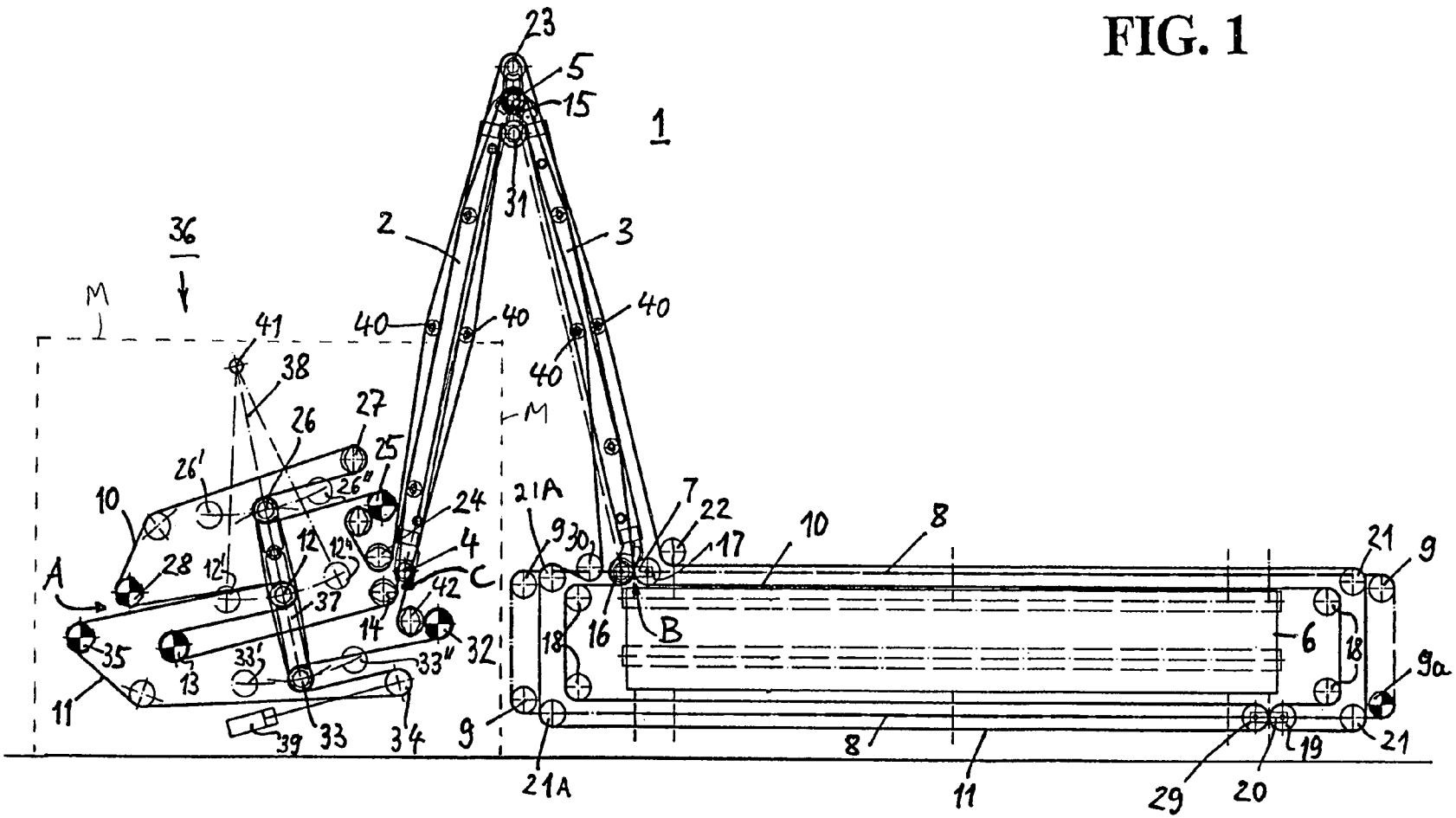
FIG. 1 schematically shows a side view of a camel back cross lapper according to the invention with a web buffering apparatus in retracted condition of the feeding and laying arms. The figure also shows web buffering apparatus.

FIG. 1 shows a cross lapper 1 with a supply arm 2 and a laying arm 3. The supply arm 2 is pivotally supported on its lower end in a lower, stationary pivot axis 4. laying arm 3 is pivotably supported in an upper pivot axis 5 on the upper end 2U of supply arm 2. The lower (free) end 3L of laying arm 3 is movably guided above an output conveyor 6 which has a transport direction which extends in parallel to pivot axes 4 and 5. Lower end 3L of the laying arm 3 is coupled to a pivot frame 7 which is guided in rails (not shown) which extend transversely across output conveyor 6 on both sides of a laying zone.

Traction ropes, toothed belts or chains 8 are attached onto pivot frame 7 and are guided over a plurality of deflection wheels 9 supported in a frame (not shown) around output conveyor 6. One or a pair of wheels 9, designated by reference number 9*a*, is driven by a motor (not shown). So configured, pivot frame 7 can be moved back and forth transversely to output conveyor 6. Both supply arm 2 and laying arm 3, arm 3 being coupled with pivot frame 7, each carry out pivoting movements.

Two endless transport belts 10 and 11, transporting a fiber web (not shown) to be layered, are guided over supply arm 2 and laying arm 3 and around output conveyor 6 in the area of the laying zone. Transport belts 10 and 11 determine a feeding path section in which transport belts 10 and 11 are guided in parallel between a take-up site A, at which the web is supplied, and a discharge nip B at lower end 3L of the laying arm 3. Thus, transport belts 10 and 11 are capable of sandwiching a fiber web between them and of supporting the web. This feeding path section extends from take-up site A via a reversing roller 12, a driven reversing roller 13, a deflection roller 14 close to lower pivot axis 4, over supply arm 2 and another deflection roller 15 supported at the upper pivot axis 5, and up to discharge nip B at lower end 3L of the laying arm 3. (The apparatus shown in FIGS. 1 and 2 contain numerous deflecting, reversing, and drive rollers which will be specified primarily by reference number only and not by differentiating names.) Discharge nip B comprises two deflecting rollers 16 and 17 which are supported on pivot frame 7 at which lower end 3L of laying arm 3 is articulated.

Starting at discharge nip B, the paths of transport belts 10 and 11 separate. In the example shown in FIG. 1, web transport belt 10 extends transversely over output conveyor 6 and two deflecting rollers 18 up to a reversing roller 19. Roller 19 is supported in a lower carriage 20, which is positioned below output conveyor 6. Carriage 20 can be moved on rails (not shown) transverse to output conveyor 6. Reversing roller 19 reverses the direction of transport belt 10. Belt 10 then runs over deflecting rollers 21 back to lower end 3L of the laying arm 3. At this point, belt 10 passes over another deflecting roller 22 and moves to a deflecting roller 23 located above upper pivot axis 5. Belt 10 then moves along supply arm 2 to a deflecting roller 24, a drive roller 25, two further reversing rollers 26 and 27, and a drive roller 28 located in the area of take-up site A. In this manner, the running path of web transport belt 10 is completed.

Web transport belt 11 runs from discharge nip B at lower end 3L of laying arm 3 via deflecting rollers 18 and below output conveyor 6 to a reversing roller 29. From reversing roller 29, belt 11 runs back via deflecting rollers 21A to a deflecting roller 30 mounted close to lower end 3L of laying arm 3, along laying arm 3 to a deflecting roller 31 located below upper pivot axis 5, along supply arm 2 and over a deflecting roller 42 arranged close to lower pivot axis 4 to a drive roller 32. Belt 11 then moves over a pair of reversing rollers 33 and 34 to a drive roller 35 located in the region of take-up site A. In this manner, the path of web transport belt 11 is completed.

FIG. 1 shows the cross lapper with supply arm 2 and laying arm 3 in a retracted position. Pivot frame 7, supporting deflecting rollers 16 and 17 at discharge nip B, is located in FIG. 1 on the left side of output conveyor 6. In this situation, lower carriage 20 supporting reversing rollers 19 and 29 is located on the right, underneath the output conveyor 6. Comparing FIG. 1 to FIG. 2, in which laying arm 2 and supply arm 3 are extended, it can be seen that by a displacement of pivot frame 7 to the right, lower carriage 20 is moved to the left by the same displacement. Corresponding to the additional length of transport belt 10 moved onto the upper side of the laying zone caused by this movement, lower carriage 20 has moved to the left, and at the same time provided a corresponding length of transport belt 11, which is supported by the coupling of traction ropes, toothed belts or chains 8 to the lower carriage 20.

Figure 2:
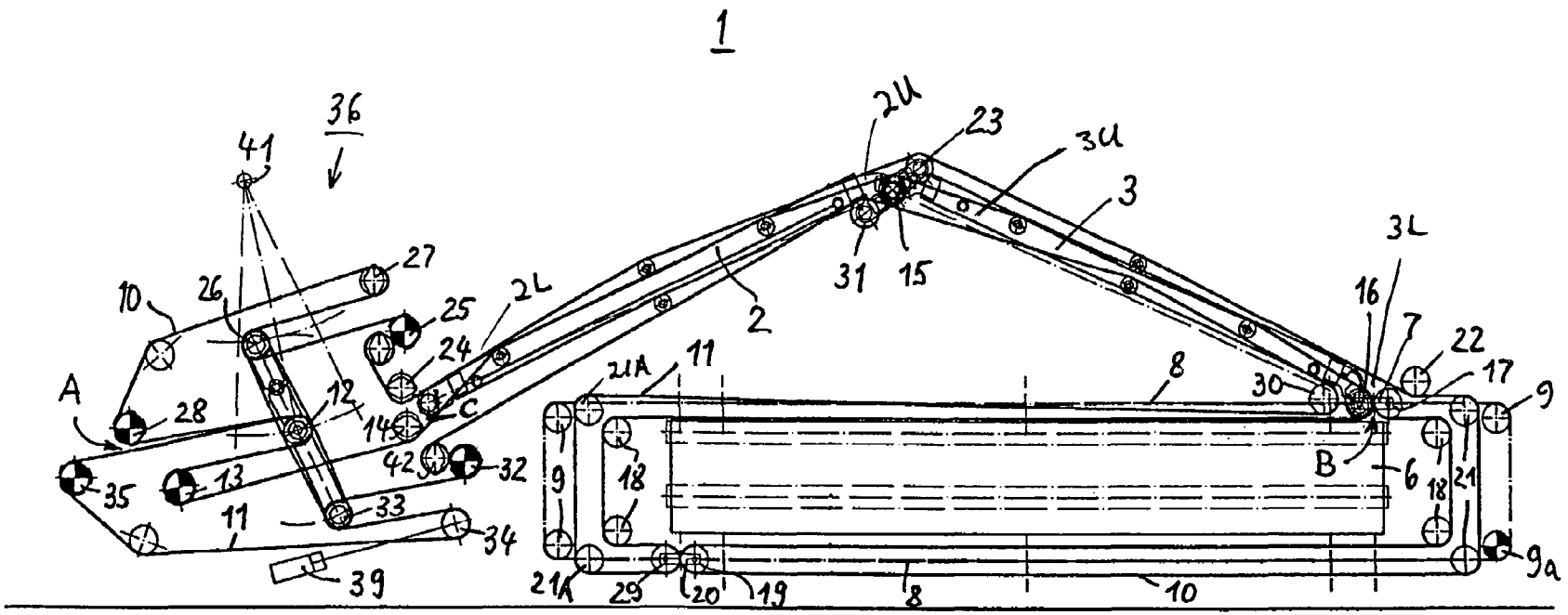
FIG. 2 shows the camel back cross lapper of FIG. 1 with the feeding and laying arms in an extended position.

When moving lower end 3L of laying arm 3 from the position shown in FIG. 1 into the position shown in FIG. 2, deflecting roller 16 supported on pivot frame 7 is rolling on web transport belt 11 layered by roller 16 if the speed at which web transport belt 10 is driven by its drive roller 32 is as high as the movement speed of pivot frame 7. Since the fiber web is discharged at this speed from discharge nip B, the section of web transport belt 11 resting on the freshly layered web does not have a relative speed with respect to the web (except for the movement of output conveyor 6 transverse to the laying direction of laying arm 3). During this movement, transport belt 10 has a speed relative to speed at take-up site A zone which consists of the sum of the running speed of pivot frame 7 and the supply speed of transport belt 10. The same applies to transport belts 10 and 11 for movement of pivot frame 7 in the reverse direction. Practice has shown that this relative speed between the layered fleece and transport belts 10 and 11 covering the layered fleece does not lead to problems. As mentioned above, pivot frame 7 is pivoted with respect to laying arm 3 around a horizontal axis, so that the deflecting roller (16 or 17) which is in front in the moving direction, is slightly lifted.

The section located between take-up site A and an infeed zone C at the lower end of supply arm 2 of the structure shown forms web buffering apparatus 36. On the way back from discharge nip B to take-up site A, transport belt 10, after leaving supply arm 2, runs over drive roller 25 and from there into a substantially U-shaped return path portion the apex of which is formed by reversing roller 26. Belt 10 continues over another reversing roller 27 and drive roller 28 to take-up site A.

On its way back to take-up site A, after leaving supply arm 2, transport belt 11 also runs over drive roller 32 into substantially U-shaped return path portion, the apex of which is formed by reversing roller 33. From there, belt 11 continues over a tensioning roller 34 and drive roller 35 which is located at the take-up site A.

Reversing rollers 26 and 33 located in the path of transport belts 10 and 11 and forming the apexes of the U-shaped return path portions, are rotatably supported in a common mounting frame 37 on which reversing roller 12 is also supported and around which the web transporting sections of transport belts 10 and 11 are guided as a pair, in juxtaposed fashion. Common mounting frame 37 is pivotally attached at the axis of reversing roller 12 at a frame-shaped link 38, which is only schematically shown in the drawing with a dash-dotted line. Link 38 is suspended like a pendulum in a pivot bearing 41 in machine stand M (shown in dotted line format only in FIG. 1) of the cross lapper.

Tensioning roller 34 is mounted on the piston of a hydraulic cylinder 39 attached to machine stand M. The force exerted by hydraulic cylinder 39 onto tensioning roller 34 tensions transport belt 11. The tension is transferred over reversing roller 33 and through common mounting frame 37, which acts as a two-armed lever by pivoting around the axis of reversing roller 12. The tension is further transferred over reversing roller 26 carried by common mounting frame 37 to the returning section of transport belt 10. Thus, both web transport belts 10 and 11 are tensioned by single hydraulic cylinder 39.

On their way over the arms 2 and 3 the transport belts 10 and 11 run over several guide rollers 40 supported on the feeding and laying arms 2 and 3, some of the guide rollers alternatingly contacting on the one and the other side of the paired transport belt section to prevent fluttering of the transport belts on the arms 2 and 3.

Various operating states will now be described. As long as drive rollers 13, 25, 28, 32 and 35 have identical circumferential speeds, common mounting frame 37 stays in the position shown in FIG. 1. If the circumferential speed of drive roller 13 becomes higher than that of the other drive rollers, drive roller 13 pulls common mounting frame 37, through paired transport belts 10 and 11 and reversing roller 12, to the left in FIG. 1, causing the length of the web transporting sections of transport belts 10 and 11 to shorten. At the same time, the length of the returning sections of transport belts 10 and 11 increases since reversing rollers 26 and 33 are also moved to the left. Positions of rollers 12, 26 and 33 moved to the left are shown in dotted lines in the drawing by reference numbers 12', 26' and 33', respectively.

If, however, the drive speed of drive roller 13 becomes lower than the speed of the other drive rollers, common mounting frame 37 moves to the right (in FIG. 1) so that reversing rollers 12, 36 and 33 reach the positions shown in FIG. 1 by reference numbers 12", 26" and 33", respectively. Since the displacement of the reversing rollers 12, 26 and 33 takes place in essentially equal amounts, transport belts 10 and 11 remain tensioned.

By the aid of the movement of common mounting frame 37, the length of transport belts 10 and 11 between take-up site A and discharge nip B can be varied. Thus, it is possible to temporarily change the speed of the web discharge at discharge nip B compared to the web infeed speed at take-up site A. This change is required for cross lapper 1, since the speed at which discharge nip B, i.e., the pivot frame 7, moves over output conveyor 6, cannot be constant, since in the area of the movement reversal points of laying arm 3, its speed must be reduced by braking to zero and then accelerated in the opposite direction after the reversal of the movement. If during these braking and accelerating phases transport belts 10 and 11 continue to discharge web through discharge nip B, web thickening would result in the marginal area of the fiber web by the cross lapper, and such variations must be prevented. Thus it is necessary to vary the speed at which the web is discharged by transport belts 10 and 11, adapting to the speed at which pivot frame 7 moves over output conveyor 6. This variation of the discharge speed of the web from discharge nip B can be managed by suitable control of the speed of drive rollers 13, 25 and 32 with respect to the speed of drive rollers 28 and 35, wherein frame 37 carries out a substantially oscillating movement around pivot bearing 41. This oscillating movement moves reversing rollers 12, 26 and 33 between positions 12', 26' and 33' on the one hand and positions 12", 26" and 33" on the other hand, and thereby cyclically changes the buffered web volume.

The structure of web buffering apparatus 36 shown can also fulfill another task. For this purpose another movement component of common mounting frame 37 will now be explained with reference to FIGS. 1 and 2. FIG. 2 shows cross lapper 1 with supply arm 2 and laying arm 3 in an extended position. It can readily be seen in FIG. 2 that the wrapping angles of transport belts 10 and 11 on deflecting rollers 15, 23 and 31, which are arranged in arms 2 and 3 in the region of upper pivot axis 5, and on deflecting rollers 14, 24 and 42, which are arranged in the region of lower pivot axis 4 of supply arm 2, vary from the wrapping angles shown in FIG. 1. While the change of the wrapping angles of the paired web transport belt sections and also the change of the wrapping angles at deflecting rollers 23 and 31 do not have opposite influences on web transport belts 10 and 11 as far the return sections thereof are concerned, the wrapping angle of the return section of belt 10 on deflecting roller 24 in FIG. 2 is smaller with respect to that in FIG. 1, whereas the wrapping angle of the returning section of belt 11 on deflecting roller 42 is greater than in FIG. 1. Such wrapping angles of web transport belts 10 and 11 therefore change in opposite directions. Transport belt 10 requires an increase in the running path length of its return section, while transport belt 11 requires a decrease in the running path length of its return section. Both can be achieved by the aid of tensioning roller 34, influenced by the hydraulic cylinder 39, which, in FIG. 2 presses the tensioning roller 34 to the right, resulting in common mounting frame 37 being pivoted from its position shown in FIG. 1 in counter-clockwise direction on link 38 into the position shown in FIG. 2. The length of the returning section of transport belt 11 is decreased, and at the same time, the length of the returning section of transport belt 10 is increased.

It is obvious that the movement of common mounting frame 37 around pivot bearing 41 of link 38 and the pivoting movement of common mounting frame 37 on link 38 around the axis of roller 12 reversing paired web transport belts 10 and 11, superimpose on one another during operation, since the compensation of the speed difference of the transport belts 10 and 11 at discharge nip B and take-up site A and the compensation of the change of the roller wrapping angles in opposite directions must take place simultaneously.

As an example of a practical embodiment of the invention, the laying width is 3,500 mm. The length of arms 2 and 3 between deflecting roller 31 and the ends of the arms is 2,800 mm each. Transport belts 2 and 3 each have a length of 21,500 mm. The movement path of lower end 3L of laying arm 3 of camel back cross lapper 1 is 4,000 mm. In the retracted condition of arms 2 and 3 (FIG. 1), arms 2 and 3 include an angle of approximately 27°, whereas in the extended position (FIG. 2), arms 2 and 3 include an angle of approximately 133°. The difference in the yielding of transport belts 10 and 11 which is caused by the change of the wrapping angles on deflecting rollers 24 and 42 (in turn caused by the different arm positions during extension), is compensated by an adjustment of approximately 20 mm on tensioning roller 34 by hydraulic cylinder 39. Frame-like link 38, at which common mounting frame 37 is suspended, has an effective length (pendulum length) of 1,400 mm, whereas the distance of reversing rollers 26 and 33 on the common mounting frame 37 from reversing roller 12 common to the transport belts is 520 mm each. For accommodating web buffering apparatus 36, a space of approximately 2,100 mm in front of the camel back cross lapper 1 and a height of approximately 1,740 mm is required, including link arrangement 31.

A variety of alternatives are possible and are obvious to the person skilled in the art of the present invention. For instance, reversing roller 12 supported on common mounting frame 37 may serve as a drive roller, whereas roller 13 may serve as an idling reversing roller. Furthermore, reversing rollers 26 and 33 supported on common mounting frame 37 may be drive rollers, with rollers 25 and 32 serving as idling deflecting rollers. Common mounting frame 37 could be pivotally supported in a movable carriage instead of being suspended on link 38. Furthermore, cross lapper 1 could have four or more hinged arms in order to achieve a larger laying width without increasing height, such hinged arms being arranged and movable in accordion-like fashion. In such case, the movement of the arms would be coordinated with movement of the laying arm. In an arrangement of this type, transport belts 10 and 11 would be guided in pairs over all of the arms articulated to one another so that the fiber web is permanently sandwiched between two tightly contacting transport belts across its entire feeding path.

The integration of web buffering apparatus, web guidance over the supply and laying arms, and the covering of the layered web on the output conveyor by using a single pair of transport belts offers excellent advantages over the prior art not only in view of the cost of the apparatus but also in view of the quality of the product produced. The fiber web to be layered for producing a fleece is held in this integrated device in uninterrupted fashion between the web transport belts from the take-up site to the discharge nip. The fiber web is free from mechanical loads caused by free suspension, by tensioning, and by transfer from one transport belt to the other. Such freedom from mechanical loads is not available in cross lappers which work with several movable carriages. This careful and conservative treatment of the fiber web is continued after leaving the discharge nip, since the web is accompanied by one of the transport belts, namely the transport belt that covers it directly after leaving the discharge nip. The web rests on a support and is free from exposure to unfavorable aerodynamic forces as well.

While the principles of the invention have been shown and described in connection with specific embodiments, it is to be understood that such embodiments are by way of example and are not limiting.

The invention claimed is:

1. A cross lapper for manufacturing a fiber fleece from a fiber web, comprising:

a supply arm having lower and upper ends and pivotably mounted at its lower end around a stationary lower pivot axis;

a downwardly extending laying arm having upper and lower ends and pivotably supported at its upper end on the supply-arm upper end around an upper pivot axis parallel to the lower pivot axis, the laying-arm lower end movable in a substantially straight path;

an endless output conveyor extending substantially parallel to the pivot axes and having a laying zone below the path of the laying-arm lower end;

two reversing rollers supported on a common carriage that is disposed below the output conveyor and is movable transversely thereto;

two endless transport belts juxtaposed for substantially continuously clamping and transporting the fiber web to be layered and guided along the supply and laying arms for receiving a fiber web at an infeed zone and for laying a fiber web in the laying zone on the output conveyor under pivoting movement of the supply and laying arms, the juxtaposed belts forming a discharge nip at the laying-arm lower end, the belts extending beyond the nip in opposite directions transversely across the laying zone in proximity to the output conveyor, the belts being separately guided to the respective reversing rollers, back to the laying-arm lower end, and from there along the laying and supply arms to the infeed zone; and drive apparatus for moving the belts, pivoting the supply and laying arms, and moving the output conveyor.

2. The cross lapper of claim 1 further including a pair of discharge nip rollers supported on the laying-arm lower end, the transport belts each passing over one of the nip rollers.

3. The cross lapper of claim 1 wherein the laying-arm lower end and the carriage are connected to one another and to the drive apparatus by one of a traction rope, a toothed belt or a chain for pivoting movement of the laying and supply arms.

4. The cross lapper of claim 3 further including a pair of discharge nip rollers supported on the laying-arm lower end, the transport belts each passing over one of the nip rollers.

5. The cross lapper of claim 2 further including a pivot frame pivotably coupled to the laying-arm lower end around an axis between and parallel to the nip rollers and adapted to pivot such that the nip roller which is forward in the movement direction of the laying-arm lower end is lifted and the other nip roller is lowered.

6. The cross lapper of claim 1 further including web buffering apparatus disposed upstream of the supply-arm lower end, the buffering apparatus guiding the transport belts, the transport belts including:

feed sections along which the belts, in juxtaposed fashion, transport the fiber web from a take-up site to the discharge nip, the juxtaposed belts running through a substantially U-shaped feed path portion substantially half-wrapped over a first deflecting roller; and return sections along which the belts move from the supply arm to the take-up site guided through U-shaped return path portions oriented in directions opposite to the orientation of the U-shaped feed path portion, each belt half-wrapping one of second and third deflecting rollers, respectively, the web buffering apparatus including a common mounting frame rotatably supporting the three deflecting rollers, thereby providing compensated length variation of the transport belts extending to and returning from the discharge nip as the laying-arm lower end traverses the laying zone on the output conveyor.

7. The cross lapper of claim 6 wherein the laying-arm lower end and the carriage are connected to one another and to the drive apparatus by one of a traction rope, a toothed belt or a chain for pivoting movement of the laying and supply arms.

8. The cross lapper of claim 6 wherein the common mounting frame is movably held in a machine stand.

9. The cross lapper of claim 8 wherein the common mounting frame is movably held by a pendulum.

10. The cross lapper of claim 6 wherein the common mounting frame is pivotably supported around the axis of the first deflecting roller.

11. The cross lapper of claim 6 further including a tensioning roller about which the belt from one of the U-shaped return path portions is substantially half-wrapped, the tensioning roller being biased away from the U-shape of such return path portion.

12. The cross lapper of claim 6 further including first and second independent drive rollers and a common drive roller, wherein the transport belts are each guided over one of the independent drive rollers and their feed sections are commonly guided over the common drive roller, the common drive roller being driven at a circumferential speed that is variable with respect to the circumferential speeds of the first and second independent drive rollers, whereby the discharge speed of the cross lapper is varied with respect to the take-up speed of the cross lapper.

13. The cross lapper of claim 6 further including first and second independent drive rollers, wherein the transport belts are each guided over one of the independent drive rollers and the first deflecting roller is also a driven roller, the first deflecting roller being driven at a circumferential speed that is variable with respect to the circumferential speeds of the first and second independent drive rollers, whereby the discharge speed of the cross lapper is varied with respect to the take-up speed of the cross lapper.

14. The cross lapper of claim 13 further including two return drive rollers, each of the return sections between the supply arm and the U-shaped return path portions wrapping at least 90° around a respective one of the return drive rollers.

15. The cross lapper of claim 6 wherein the supply and laying arms each have guide rollers alternatingly contacting opposite sides of the juxtaposed feed sections of the transport belts.

16. The cross lapper of claim 15 further including two return drive rollers, each of the return sections between the supply arm and the U-shaped return path portions wrapping at least 90° around a respective one of the return drive rollers.

* * * * *

UNITED STATES PATENT AND TRADEMARK OFFICE

CERTIFICATE OF CORRECTION

PATENT NO. : 7,318,255 B2
APPLICATION NO. : 11/075123
DATED : January 15, 2008
INVENTOR(S) : Peter Bastian and Joachim Leger It is certified that error appears in the above-identified patent and that said Letters Patent is hereby corrected as shown below:

In column 2, line 26, delete “and arms for receiving” and insert --and layering arms for receiving--.

Signed and Sealed this

First Day of July, 2008

JON W. DUDAS
*Director of the United States Patent and Trademark Office*